US007956716B2

(12) United States Patent
Tada et al.

(10) Patent No.: US 7,956,716 B2
(45) Date of Patent: Jun. 7, 2011

(54) SURFACE MOUNT VARIABLE RESISTOR

(75) Inventors: Morio Tada, Toyama (JP); Masanori Urayama, Toyama (JP)

(73) Assignee: Hokuriku Electric Industry Co., Ltd., Toyama-shi (JP)

( * ) Notice: Subject to any disclaimer, the term of this patent is extended or adjusted under 35 U.S.C. 154(b) by 374 days.

(21) Appl. No.: 12/374,439

(22) PCT Filed: Jul. 19, 2007

(86) PCT No.: PCT/JP2007/064217

§ 371 (c)(1),
(2), (4) Date: Jan. 20, 2009

(87) PCT Pub. No.: WO2008/010535

PCT Pub. Date: Jan. 24, 2008

(65) Prior Publication Data

US 2009/0267725 A1 Oct. 29, 2009

(30) Foreign Application Priority Data

Jul. 21, 2006 (JP) ..... 2006-199302

(51) Int. Cl.
*H01C 10/32* (2006.01)

(52) U.S. Cl. ..... 338/162; 338/322

(58) Field of Classification Search ..... 338/160–162, 338/118, 322

See application file for complete search history.

(56) References Cited

U.S. PATENT DOCUMENTS

| | | | | |
|---|---|---|---|---|
| 5,525,956 | A * | 6/1996 | Hashizume et al. | 338/322 |
| 5,952,912 | A * | 9/1999 | Bauer et al. | 338/162 |
| 6,342,829 | B1 * | 1/2002 | Takagi et al. | 338/153 |
| 6,744,647 | B2 * | 6/2004 | Cohen | 363/71 |
| 7,077,656 | B2 * | 7/2006 | Miura | 439/22 |
| 2001/0015690 | A1 * | 8/2001 | Masuda et al. | 338/162 |

FOREIGN PATENT DOCUMENTS

| | | |
|---|---|---|
| CN | 1552079 | 12/2004 |
| JP | 59-93103 | 6/1984 |
| JP | 62-199820 | 12/1987 |
| JP | 09-035913 | 2/1997 |
| JP | 2000-340409 | 12/2000 |
| JP | 2001-143912 | 5/2001 |
| JP | 2002-246208 | 8/2002 |
| JP | 2003-077713 | 3/2003 |
| JP | 2003-077714 | 3/2003 |
| JP | 2004-277837 | 10/2004 |

OTHER PUBLICATIONS http://industrial.panasonic.com/www-cgi/jvcr13pz.cgi?j+PZ+2+AOI0005+O+4+JP Panasonic Cermet 4 mm Square Open/Trimmer/Potentionmeteres/Passive & Electromechanic.

* cited by examiner

*Primary Examiner* — Kyung Lee
(74) *Attorney, Agent, or Firm* — Rankin, Hill & Clark LLP

(57) ABSTRACT

A surface mount variable resistor meets the needs of user for front and rear terminals of an insulating substrate. The surface mount variable resistor includes an insulating substrate 1 with a variable resistor pattern 3 and electrode patterns 5 formed thereon, resistor termination terminal fittings 7 connected to the electrode patterns 5, an electrically conductive slider 15 including a sliding contact 15*c* that slides on the variable resistor pattern 3, and an intermediate terminal 17 that includes a rear intermediate terminal fitting portion 17*a* and is electrically connected to the electrically conductive slider 15. The intermediate terminal 17 includes an extended conductor portion 17*c* and the rear intermediate terminal fitting portion 17*a* integrally formed with the extended conductor portion 17*c*. A front intermediate terminal fitting portion 17*d* located between the resistor termination terminal fittings 7 is integrally formed with the extended conductor portion 17*c*.

11 Claims, 3 Drawing Sheets

SURFACE MOUNT VARIABLE RESISTOR

TECHNICAL FIELD

The present invention relates to a surface mount variable resistor.

BACKGROUND ART

A surface mount variable resistor includes an insulating substrate, a pair of solderable resistor termination terminal fittings, a rotatable electrically conductive slider, and an intermediate terminal. On a front surface of the insulating substrate, a variable resistor pattern of substantially an arc shape and a pair of electrode patterns connected to both ends of the variable resistor pattern are formed. The pair of resistor termination terminal fittings are connected to the pair of electrode patterns. The slider includes a sliding contact which slides on the variable resistor pattern. The intermediate terminal is electrically connected to the electrically conductive slider and includes a solderable rear intermediate terminal portion on a side opposite to a side of the insulating substrate where the pair of resistor termination terminal fittings are provided. The pair of resistor termination terminal fittings are aligned on a front side of the insulating substrate. The intermediate terminal is constituted by a passing-through conductor portion that passes through a through-hole of the insulating substrate, an extended conductor portion that is coupled to the passing-through conductor portion and extends along a back surface of the insulating substrate, and the rear intermediate terminal portion arranged on a rear side of the insulating substrate. Namely, this is a three-terminal structure in which two resistor termination terminal fittings are provided on the front side of the insulating substrate and one rear intermediate terminal portion is provided on the rear side of the insulating substrate (refer to Patent Document 1, for example).

Another three-terminal structure has been proposed and carried out, which includes two resistor termination terminal fittings and one front intermediate terminal portion on a front side of an insulating substrate (refer to Non-patent Document 1, for example).

Patent Document 1: Japanese Patent Publication No. 1997-35913 (JP1997-35913A) FIGS. 1 to 3

Nonpatent Document 1: http://industrial.panasonic.com/www-cgi/jvcr13pz.cgi?J+PZ+2+AOI0005+O+4+JP

DISCLOSURE OF THE INVENTION

Problems to be Solved by the Invention

However, there is a problem that the surface mount variable resistor of the former type including two terminals on its front side and one terminal on its rear side is not preferred by a user who desires the surface mount variable resistor of the latter type that includes three terminals aligned on its front side. The surface mount variable resistor of the latter type is not preferred by a user who desires the surface mount variable resistor of the former type.

An object of the present invention is to provide a surface mount variable resistor that may be used both by the user who desires the surface mount variable resistor of the former type (including two terminals on its front side and one terminal on its rear side) and by the user who desires the surface mount variable resistor of the latter type (including three terminals aligned on its front side).

Another object of the present invention is to provide a surface mount variable resistor in which an electrically conductive slider may be rotated from a desired side of an insulating substrate.

Another object of the present invention is to provide a surface mount variable resistor capable of preventing molten solder from flowing into a gap between a through-hole of an insulating substrate and a passing-through conductor portion that passes through the through-hole of the insulating substrate, thereby preventing an electrically conductive slider from becoming incapable of rotating due to the molten solder flow at a time of surface mounting.

Still another object of the present invention is to provide a surface mount variable resistor capable of preventing resistor termination terminal fittings from being detached from an insulating substrate.

Means for Solving the Problems

The present invention that achieves the above-mentioned objects is configured as described below.

A surface mount variable resistor of the present invention includes an insulating substrate. A variable resistor pattern and a pair of electrode patterns are formed on a front surface of the insulating substrate. The pair of electrode patterns are connected to both ends of the variable resistor pattern. A pair of solderable resistor termination terminal fittings are connected to the pair of electrode patterns. An electrically conductive slider is rotatably disposed on a portion of the front surface of the insulating substrate that is surrounded by the variable resistor pattern. The electrically conductive slider includes a sliding contact, which slides on the variable resistor pattern. An intermediate terminal electrically is connected to the electrically conductive slider. The intermediate terminal includes a solderable rear intermediate terminal fitting portion on a side opposite to a side of the insulating substrate where the pair of resistor termination terminal fittings are provided. The intermediate terminal further includes a passing-through conductor portion that passes through a through-hole of the insulating substrate; and an extended conductor portion that is electrically connected to the passing-through conductor portion and extends along a back surface of the insulating substrate. Then, the extended conductor portion integrally includes the rear intermediate terminal fitting portion.

In the surface mount variable resistor of the present invention in particular, a solderable front intermediate terminal fitting portion that is located between the pair of resistor termination terminal fittings is integrally formed with the extended conductor portion of the intermediate terminal.

The surface mount variable resistor of the present invention includes three terminals composed of the pair of resistor termination terminal fittings and the front intermediate terminal fitting portion on a front portion of the insulating substrate, and includes one terminal composed of the rear intermediate terminal fitting portion on a rear portion of the insulating substrate. For this reason, by using the pair of resistor termination terminal fittings and the rear intermediate terminal fitting portion, the surface mount variable resistor of the present invention may be used as the surface mount variable resistor of the former type described above (including two terminals on its front side and one terminal on its rear side). Alternatively, by using the pair of resistor termination terminal fittings and the front intermediate fitting portion on the front portion of the insulating substrate, the surface mount variable resistor of the present invention may be employed as the surface mount variable resistor of the latter type described above (including three terminals aligned on its front side). Accordingly, the surface mount variable resistor may be used both by a user who desires the surface mount variable resistor of the former type and by a user who desires the surface mount variable resistor of the latter type.

Assume that the passing-through conductor portion of the intermediate terminal is formed to be mechanically connected to the electrically conductive slider, and is formed to be capable of rotating relative to the extended conductor portion of the intermediate terminal when electrically connected to the extended conductor portion, in the surface mount variable resistor of the structure as described above. Then, the electrically conductive slider may be rotated by turning the passing-through conductor portion of the intermediate terminal with the extended conductor portion of the intermediate terminal fixed.

When the passing-through conductor portion of the intermediate terminal includes a rotational movement operating portion in such a structure, the electrically conductive slider can be rotated by turning the passing-through conductor portion.

When the rotational movement operating portion is provided on a back surface side of the insulating substrate in such a structure, the electrically conductive slider may be rotated by turning the passing-through conductor portion from the back surface side of the insulating substrate.

When the passing-through conductor portion of the intermediate terminal is mechanically formed integrally with the extended conductor portion, and does not move rotationally and is electrically connected to the electrically conductive slider when the electrically conductive slider moves rotationally, the electrically conductive slider may be rotated with the passing-through conductor portion fixed.

When the electrically conductive slider includes a rotational movement operating portion in such a structure, the electrically conductive slider may be rotated by operating the rotational movement operating portion.

On the extended conductor portion of the intermediate terminal, a first molten solder flow prevention region and a second molten solder flow prevention region are provided. The first molten solder flow prevention region is located between an end of the passing-through conductor portion and the rear intermediate terminal fitting portion to prevent molten solder from flowing from the rear intermediate terminal fitting portion to the passing-through conductor portion. The second molten solder flow prevention region is located between the front intermediate terminal fitting portion and the end of the passing-through conductor portion to prevent molten solder from flowing from the front intermediate terminal fitting portion to the passing-through conductor portion. When these molten solder flow prevention regions are provided, the molten solder can be prevented from flowing through a gap between the through-hole of the insulating substrate and the passing-through conductor portion of the intermediate terminal that passes through the through-hole. The electrically conductive slider may be thereby prevented from becoming incapable of rotating due to the molten solder flow.

When a solderable plating layer is formed on surfaces of the extended conductor portion, the rear intermediate terminal fitting portion, and the front intermediate terminal fitting portion, and the first and second molten solder flow prevention regions are formed by partially removing the plating layer in such a structure, the first and second molten solder flow prevention regions may be readily formed by partially removing this plating layer by laser radiation, for example.

Assume that the pair of the resistor termination terminal fittings each comprise a back-side contact plate portion that is in contact with the back surface of the insulating substrate; a rising portion that is integrally formed with the back-side contact plate portion and rises along a front end surface of the insulating substrate; a first gripping member that is integral with and raised from an inward-facing corner portion of the back-side contact plate portion located on a rear side of the back-side contact plate portion, passes through a resistor termination terminal fitting through-hole formed in the insulating substrate, and is then folded back on the electrode pattern on the front surface of the insulating substrate; a second gripping member that is integrally provided with a tip of the rising portion and is folded back along the front surface of the insulating substrate; and a solder layer that electrically connects the first and second gripping members to the electrode pattern. Then, the resistor termination terminal fitting may be prevented from being detached from the insulating substrate, with reliability.

When a gap is provided between an end surface of the insulating substrate and the front intermediate terminal fitting portion to prevent molten solder from rising, the molten solder may be prevented from rising between the insulating substrate and a rising portion of the front intermediate terminal fitting portion, and then reaching the front surface of the insulating substrate at a time of surface mounting.

BEST MODE FOR CARRYING OUT THE INVENTION

An embodiment of the present invention will be described below in detail with reference to drawings.

Figure 1:
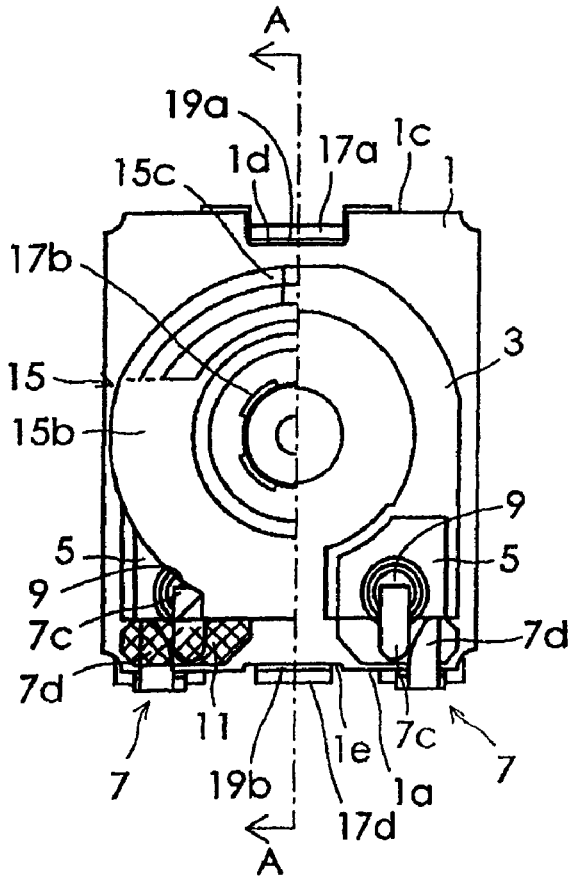
FIG. 1 is a plan view showing that a slider of a surface mount variable resistor in an embodiment of the present invention has partially been cut out.
Figure 2:
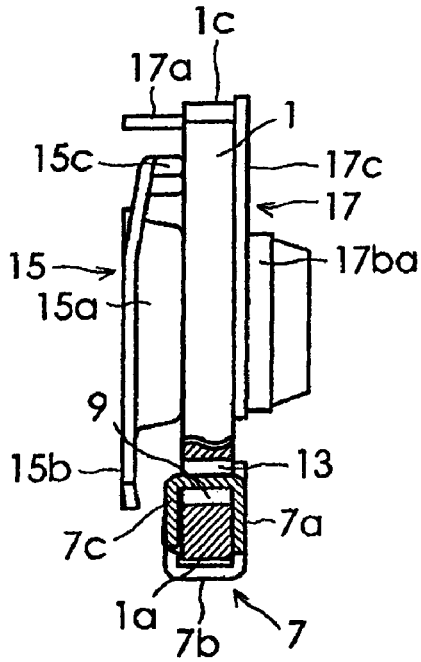
FIG. 2 is a right-side view of FIG. 1 in which the slider has partially been cut out.
Figure 3:
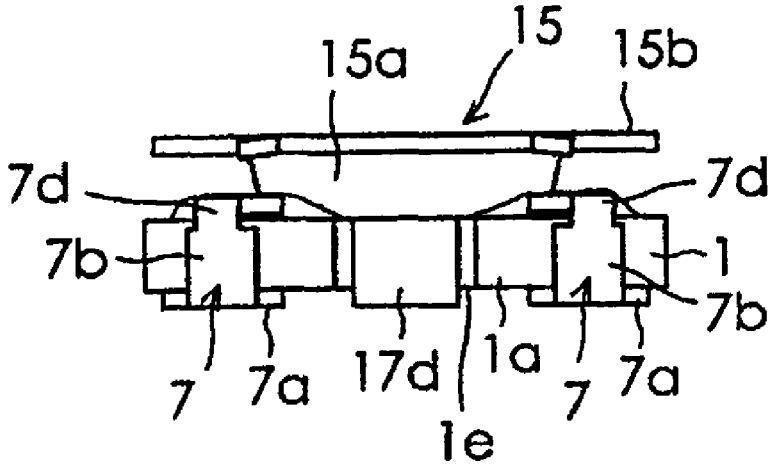
FIG. 3 is a front view of FIG. 1.
Figure 4:
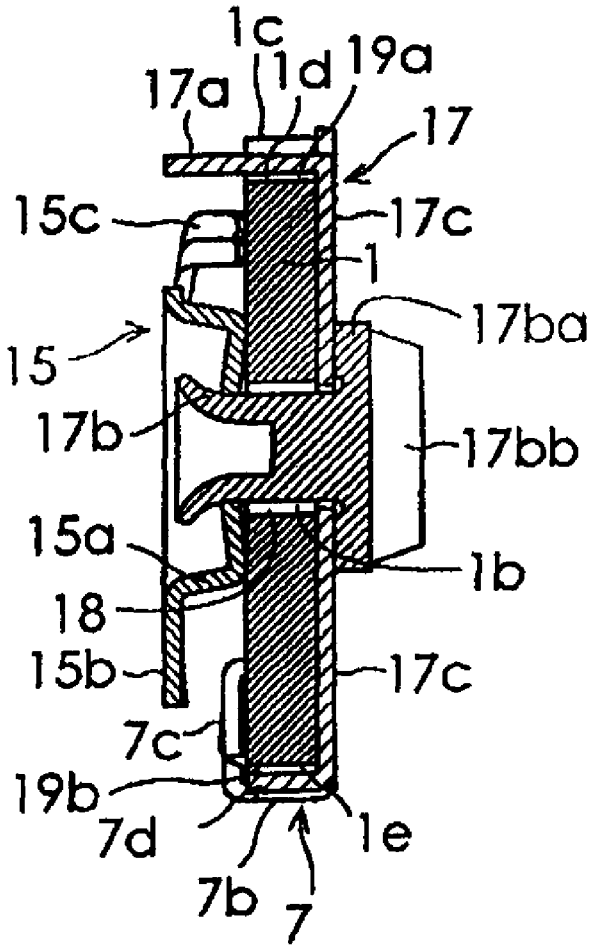
FIG. 4 is a sectional view taken along line A-A in FIG. 1.
Figure 5:
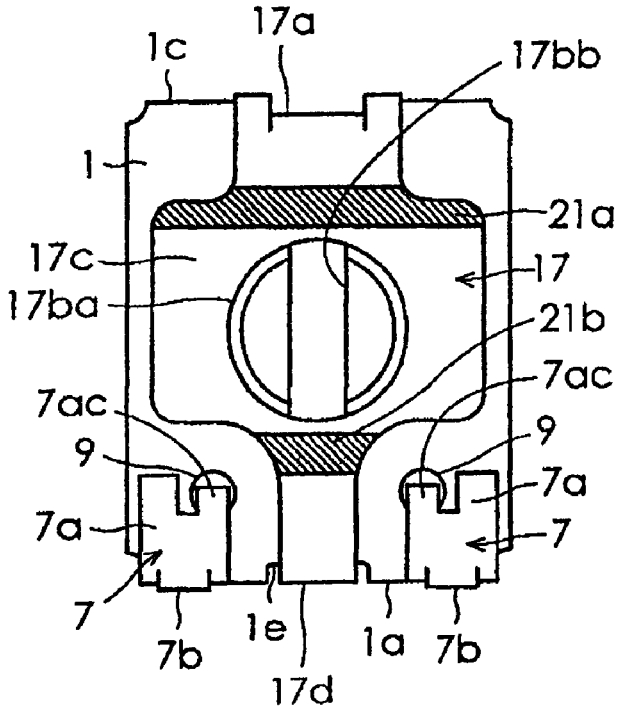
FIG. 5 is a bottom surface view of FIG. 1.

FIGS. 1 through 5 show the embodiment of a surface mount variable resistor of the present invention. FIG. 1 is a plan view showing that a slider of the surface mount variable resistor in this embodiment has partially been cut out. FIG. 2 is a right-side view of FIG. 1 in which the slider has partially been cut out. FIG. 3 is a front view of FIG. 1, FIG. 4 is a sectional view taken along line A-A in FIG. 1, and FIG. 5 is a bottom surface view of FIG. 1.

As shown in FIGS. 1 through 5, the surface mount variable resistor in this embodiment includes an insulating substrate 1 formed by processing a ceramic substrate or the like. As shown in FIG. 1, a variable resistor pattern 3 of substantially an arc shape and a pair of electrode patterns 5 connected to both ends of this variable resistor pattern 3 are formed on a front surface of this insulating substrate 1. A pair of solderable resistor termination terminal fittings 7 are connected to the pair of electrode patterns 5.

As shown in FIGS. 1 through 5, the pair of resistor termination terminal fittings 7 each include a back-side contact plate portion 7*a*, a rising portion 7*b*, a first gripping member 7*c*, a second gripping member 7*d*, and a solder layer 11. The back-side contact plate portion 7*a* is in contact with a back surface of the insulating substrate 1. The rising portion 7*b* is integrally formed with the back-side contact plate portion 7*a* and rises along a front end surface 1*a* of the insulting substrate 1. The first gripping member 7*c* is integral with and raised from an inward-facing corner portion 7*ac* of the back-side contact plate portion 7*a* located on a rear side of the back-side contact plate portion 7*a*, passes through a resistor termination terminal fitting through-hole 9 formed in the insulating substrate 1, and is then folded back on the electrode pattern 5 on the front surface of the insulating substrate 1. The second gripping member 7*d* is integrally formed with a tip of the rising portion 7*b* and is folded back along the front surface of the insulating substrate 1. The solder layer 11 electrically connects the first gripping member 7*c* and the second gripping member 7*d* to the electrode pattern 5. As shown in FIG. 2, a gap 13 is provided between an inner wall of the resistor termination terminal fitting through-hole 9 and the first gripping member 7*c* in the resistor termination terminal fitting through-hole 9. The gap 13 prevents molten solder from rising at a time of surface mounting.

An electrically conductive slider 15, which is rotatably disposed on a portion of the front surface of the insulating substrate 1 surrounded by the variable resistor pattern 3, is arranged on a front surface side of the insulating substrate 1. The electrically conductive slider 15 includes a cap-like portion 15*a*, a flange portion 15*b*, and a sliding contact 15*c*. The flange portion 15*b* is provided, protruding outwardly from an upper end outer circumference of the cup-like portion 15*a*. The sliding contact 15*c* is integrally formed with a portion of an outer circumference of the flange portion 15*b* in a circumferential direction and slides on the variable resistor pattern 3.

In this embodiment, an intermediate terminal 17 is provided, being electrically connected to the electrically conductive slider 15. The intermediate terminal 17 includes a solderable rear intermediate terminal fitting portion 17*a* on a side (of a rear end surface 1*c* of the insulating substrate 1 which will be described later) opposite to a side of the front end surface 1*a* of the insulating substrate 1 where the pair of resistor termination terminal fittings 7 are provided. The intermediate terminal 17 includes a passing-through conductor portion 17*b* that passes through a through-hole 1*b* of the insulating substrate 1 and an extended conductor portion 17*c* that is electrically connected to the passing-through conductor portion 17*b* and extends along the back surface of the insulating substrate 1. Then, the rear intermediate terminal fitting portion 17*a* is integrally formed with the extended conductor portion 17*c*. The rear intermediate terminal fitting portion 17*a* is formed at a recessed portion 1*d* provided in the rear end surface 1*c* of the insulating substrate 1, as shown in FIG. 1. A gap 19*a*, which prevents molten solder from rising at a time of surface mounting, is formed between a bottom wall of the recessed portion 1*d* and the rear intermediate terminal fitting portion 17*a*, as shown in FIG. 4.

In this embodiment in particular, a solderable front intermediate terminal fitting portion 17*d* located between the pair of resistor termination terminal fittings 7 provided at the front end surface 1*a* of the insulting substrate 1 is integrally formed with the extended conductor portion 17*c* of the intermediate terminal 17. As shown in FIG. 1, the front intermediate terminal fitting portion 17*d* is formed at a recessed portion 1*e* provided in the front end surface 1*a* of the insulating substrate 1. As shown in FIG. 4, a gap 19*b*, which prevents molten solder from rising at a time of surface mounting, is formed between a bottom wall of this recessed portion 1*e* and the front intermediate terminal fitting portion 17*d*. When the front intermediate terminal fitting portion 17*d* is arranged within the recessed portion 1*e*, an edge surface distance between the front intermediate terminal fitting portion 17*d* and rising portions 7*b* of the resistor termination terminal fittings 7 on left and right sides of the front intermediate fitting portion 17*d* is increased. A short circuit between the front intermediate terminal fitting portion 17*d* and the resistor termination terminal fittings 7 on the left and right sides of the front intermediate terminal fitting portion 17*d* at a time of soldering may be thereby prevented.

In this embodiment, the passing-through conductor portion 17*b* of the intermediate terminal 17 is mechanically connected to the electrically conductive slider 15 so that the passing-through conductor portion 17*b* may rotate together with the electrically conductive slider 15. In order to do so, the passing-through conductor portion 17*b* is expanded outwardly like a trumpet on the side of the front surface of the insulating substrate 1 and is then staked or caulked with respect to the electrically conductive slider 15. An extended diameter portion 17*ba* is integrally formed with the passing-through conductor portion 17*b* on the side of the back surface of the insulating substrate 1. By rotatably and electrically bringing the extended diameter portion 17*ba* into contact with the extended conductor portion 17*c*, the passing-through conductor portion 17*b* is capable of mechanically rotating relative to the extended conductor portion 17*c*.

As shown in FIG. 4, a rotational movement operating portion 17*bb* for rotating the passing-through conductor portion 17*b* is provided at an end surface of the extended diameter portion 17*ba* of the passing-through conductor portion 17*b*. A groove like a slotted screwdriver groove is formed in the rotational movement operating portion 17*bb* in this embodiment. To be more specific, the rotational movement operating portion 17*bb* is provided on the side of the back surface of the insulating substrate 1.

As shown in FIG. 5, a first molten solder flow prevention region 21*a* is formed on the extended conductor portion 17*c* of the intermediate terminal 17 between an end of the passing-through conductor portion 17*b* of the intermediate terminal 17 and the rear intermediate terminal fitting portion 17*a* of the intermediate terminal 17. The first molten solder flow prevention region 21*a* prevents molten solder from flowing from the rear intermediate terminal fitting portion 17*a* to the passing-through conductor portion 17*b*. Then, a second molten solder flow prevention region 21*b* is formed on the extended conductor portion 17*c* of the intermediate terminal 17 between the end of the passing-through conductor portion 17*b* of the intermediate terminal 17 and the front intermediate terminal fitting portion 17*d* of the intermediate terminal 17. The second molten solder flow prevention region 21*b* prevents molten solder from flowing from the front intermediate terminal fitting portion 17*d* to the passing-through conductor portion 17*b*.

On surfaces of the extended conductor portion 17*c* of the above-mentioned structure, the rear intermediate terminal fitting portion 17*a*, and the front intermediate terminal fitting portion 17*d*, a solderable plating layer is formed, and the first and second molten solder flow prevention regions 21*a* and 21*b* are formed by partially removing the plating layer. In this structure, by partially removing the plating layer by laser irradiation or the like, for example, the first molten solder flow prevention region 21*a* and the second molten solder flow prevention region 21*b* may be readily formed.

In the surface mount variable resistor of the structure described above, a signal corresponding to a resistance value of the variable resistor may be obtained from the rear intermediate terminal fitting portion 17*a* or the front intermediate terminal fitting portion 17*b* through the passing-through conductor portion 17*b* and the extended conductor portion 17*c*.

The resistance value is determined according to a position of the sliding contact 15*c* that is changed as the electrically conductive slider 15 and the passing-through conductor portion 17*b* are rotated by the rotational movement operating portion 17*bb*.

Further, the surface mount variable resistor of this embodiment includes three terminals constituted by the pair of resistor termination terminal fittings 7 and the front intermediate terminal fitting portion 17*d* on a front portion of the insulating substrate 1, and one terminal constituted by the rear intermediate terminal fitting portion 17*a* on a rear portion of the insulating substrate 1. Thus, the surface mount variable resistor may be used as the surface mount variable resistor of the former type described above (including two terminals on its front side and one terminal on its rear side) by using the pair of resistor termination terminal fittings 7 and the rear intermediate terminal fitting portion 17*a*. Further, by using the pair of resistor termination terminal fittings 7 and the front intermediate terminal fitting portion 17*d* on the front portion of the insulating substrate 1, the surface mount variable resistor in this embodiment may be used as the surface mount variable resistor of the latter type described above (including three terminals aligned on its front side). Accordingly, the surface mount variable resistor of the present invention may be used both by a user who desires the surface mount variable resistor of the former type and a user who desires the surface mount variable resistor of the latter type.

In the surface mount variable resistor of this structure, the passing-through conductor portion 17*b* of the intermediate terminal 17 is formed to be mechanically connected to the electrically conductive slider 15 as shown in FIG. 4, and is formed to be capable of rotating relative to the extended conductor portion 17*c* when electrically connected to the extended conductor portion 17*c* of the intermediate terminal 17. Thus, the electrically connective slider 15 may be rotated by turning the passing-through conductor portion 17*b* of the intermediate terminal 17 with the extended conductor portion 17 of the intermediate terminal 17 fixed. Further, the rotational movement operating portion 17*bb* is provided at the passing-through conductor portion 17*b* of the intermediate terminal 17. Thus, the electrically conductive slider 15 may be rotated by turning the passing-through conductor portion 17*b*. In this embodiment, the rotational movement operating portion 17*bb* is formed on the back surface side of the insulating substrate 1. Thus, the electrically conductive slider 15 may be rotated by turning the passing-through conductor portion 17*b* from the back surface side of the insulating substrate 1.

On the extended conductor portion 17*c* of the intermediate terminal 17 between the end of the passing-through conductor portion 17*b* and the rear intermediate terminal fitting portion 17*a*, the first molten solder flow prevention region 21*a* is formed. The first molten solder flow prevention region 21*a* prevents molten solder from flowing from the rear intermediate terminal fitting portion 17*a* to the passing-through conductor portion 17*b*. Then, on the extended conductor portion 17*c* of the intermediate terminal 17 between the end of the passing-through conductor portion 17*b* and the front intermediate terminal fitting portion 17*d*, the second molten solder flow prevention region 21*b* is formed. The second molten solder flow prevention region 21*b* prevents molten solder from flowing from the front intermediate terminal fitting portion 17*d* to the passing-through conductor portion 17*b*. Accordingly, the molten solder may be prevented from flowing into a gap 18 between the through-hole 1*b* of the insulating substrate 1 and the passing-through conductor portion 17*b* of the intermediate terminal 17 that passes through the through-hole 1*b*, at a time of surface mounting. The electrically conductive slider 15 is thereby prevented from becoming incapable of rotating due to the molten solder flow.

The pair of resistor termination terminal fittings 7 each include the back-side contact plate portion 7*a* that is in contact with the back surface of the insulating substrate 1; the rising portion 7*b* that is integrally formed with the back-side contact plate portion 7*a* and rises along the front end surface 1*a* of the insulating substrate 1; the first gripping member 7*c* that is integral with and raised from the inward-facing corner portion 7*ac* of the back-side contact plate portion 7*a* located on the rear side of the back-side contact plate portion 7*a*, passes through the resistor termination terminal fitting through-hole 9 formed in the insulating substrate 1, and is then folded back on the electrode pattern 5 on the front surface of the insulating substrate 1; the second gripping member 7*b* that is integrally formed with the tip of the rising portion 7*b* and is folded back along the front surface of the insulating substrate 1; and the solder layer 11 that electrically connects the first gripping member 7*c* and the second gripping member 7*d* to the electrode patterns 5. Thus, the resistor termination terminal fitting 7 may be positively prevented from being detached from the insulating substrate 1.

The gap 19*b* capable of preventing the molten solder from rising is provided between the end surface of the insulating substrate 1 and the front intermediate fitting portion 17*d*. Thus, the molten solder may be prevented from rising between the insulating substrate 1 and a rising portion of the front intermediate fitting portion 17*d* and then reaching the front surface of the insulating substrate 1.

Figure 6:
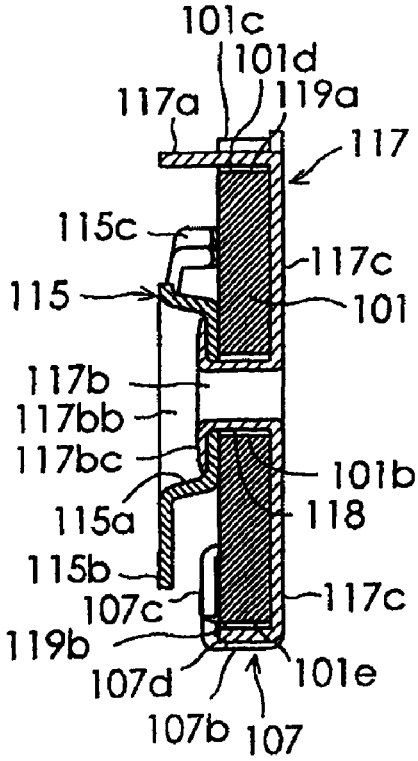
FIG. 6 is a sectional view showing a variation example of the surface mount variable resistor of the present invention.

FIG. 6 is a vertical sectional view showing another embodiment (variation example) of a surface mount variable resistor of the present invention. To components in FIG. 6 that are common to those in FIGS. 1 through 5 described above, reference numerals obtained by adding 100 to reference numerals in FIGS. 1 through 5 are assigned. Descriptions of the components in FIG. 6 will be thereby omitted.

In the surface mount variable resistor in this embodiment, a passing-through conductor portion 117*b* of an intermediate terminal 117 is made mechanically and electrically integral with an extended conductor portion 117*c*. For this reason, the passing-through conductor portion 117*b* is fixed and does not rotate. An electrically conductive slider 115 is capable of rotating when electrically connected to this fixed passing-through conductor portion 117*b*. An end of the passing-through conductor portion 117*b* that has extended through a cup-like portion 115*a* of the electrically conductive slider 115 is staked or caulked into a staked or caulked portion 117*bc*. The staked or caulked portion 117*bc* prevents the cup-like portion 115*a* from being detached from the passing-through conductor portion 117*b*. A rotational movement operating portion 117*bb* for rotating the electrically conductive slider 115 is provided in a flange portion 115*b* of the electrically conductive slider 115. A groove like a slotted screwdriver groove is formed in the rotational movement operating portion 117*bb*.

With this structure, by turning the rotational movement operating portion 117*bb*, the electrically conductive slider 115 may be rotated with the passing-through conductor portion 117*b* fixed. A signal corresponding to a resistance value of the variable resistor may be obtained from a rear intermediate terminal fitting portion 117*a* or a front intermediate terminal fitting portion 117*d* through the passing-through conductor portion 117*b* and the extended conductor portion 117*c*. The resistance value is determined according to a position of the sliding contact 115*c* that is changed as the electrically conductive slider 115 is rotated.

INDUSTRIAL APPLICABILITY

The surface mount variable resistor of the present invention includes three terminals composed of the pair of resistor termination terminal fittings and the front intermediate terminal fitting portion on the front portion of the insulating substrate, and one terminal composed of the rear intermediate terminal fitting portion on the rear portion of the insulating substrate. Thus, by using the pair of resistor termination terminal fittings and the rear intermediate terminal fitting portion, the surface mount variable resistor of the present invention may be used as the surface mount variable resistor of the former type described above (including two terminals on its front side and one terminal on its rear side). Further, by using the pair of resistor termination terminal fittings and the front intermediate fitting portion on the front portion of the insulating substrate, the surface mount variable resistor of the present invention may be used as the surface mount variable resistor of the latter type described above (including three terminals aligned on its front side) described above. Accordingly, the surface mount variable resistor of the present invention may be used both by the user who desires the surface mount variable resistor of the former type and by the user who desires the surface mount variable resistor of the latter type.

The invention claimed is:

1. A surface mount variable resistor comprising:

an insulating substrate with a variable resistor pattern and a pair of electrode patterns formed on a front surface thereof, wherein the pair of electrode patterns are connected to both ends of the variable resistor pattern;

a pair of solderable resistor termination terminal fittings connected to the pair of electrode patterns;

an electrically conductive slider that includes a sliding contact, which slides on the variable resistor pattern, and is rotatably disposed on a portion of the front surface of the insulating substrate that is surrounded by the variable resistor pattern; and an intermediate terminal electrically connected to the electrically conductive slider and including a solderable rear intermediate terminal fitting portion on a side opposite to a side of the insulating substrate where the pair of resistor termination terminal fittings are provided;

the intermediate terminal further including:

a passing-through conductor portion that passes through a through-hole of the insulating substrate;

an extended conductor portion that is electrically connected to the passing-through conductor portion and extends along a back surface of the insulating substrate and that is integrally formed with the rear intermediate terminal fitting portion; and a solderable front intermediate terminal fitting portion that is located between the pair of resistor termination terminal fittings and that is integrally formed with the extended conductor portion of the intermediate terminal.

2. The surface mount variable resistor according to claim 1, wherein the passing-through conductor portion of the intermediate terminal is mechanically connected to the electrically conductive slider, and is capable of rotating relative to the extended conductor portion of the intermediate terminal when electrically connected to the extended conductor portion.

3. The surface mount variable resistor according to claim 2, wherein the passing-through conductor portion includes a rotational movement operating portion.

4. The surface mount variable resistor according to claim 3, wherein the rotational movement operating portion is provided on a side of the back surface of the insulating substrate.

5. The surface mount variable resistor according to claim 1, wherein the passing-through conductor portion of the intermediate terminal is mechanically integrally formed with the extended conductor portion, and does not move rotationally and is electrically connected to the electrically conductive slider when the electrically conductive slider moves rotationally.

6. The surface mount variable resistor according to claim 5, wherein the electrically conductive slider includes a rotational movement operating portion.

7. The surface mount variable resistor according to claim 1, wherein a first molten solder flow prevention region and a second molten solder flow prevention region are provided on the extended conductor portion, the first molten solder flow prevention region being located between an end of the passing-through conductor portion and the rear intermediate terminal fitting portion to prevent molten solder from flowing from the rear intermediate terminal fitting portion to the passing-through conductor portion;

the second molten solder flow prevention region being located between the front intermediate terminal fitting portion and the end of the passing-through conductor portion to prevent molten solder from flowing from the front intermediate terminal fitting portion to the passing-through conductor portion.

8. The surface mount variable resistor according to claim 7, wherein a solderable plating layer is formed on surfaces of the extended conductor portion, the rear intermediate terminal fitting portion, and the front intermediate terminal fitting portion, and the first and second molten solder flow prevention regions are formed by partially removing the plating layer.

9. The surface mount variable resistor according to claim 1, wherein the pair of the resistor termination terminal fittings each comprise:

a back-side contact plate portion that is in contact with the back surface of the insulating substrate;

a rising portion that is integrally formed with the back-side contact plate portion and rises along a front end surface of the insulating substrate;

a first gripping member that is integral with and raised from an inward-facing corner portion of the back-side contact plate portion located on a rear side of the back-side contact plate portion, passes through a resistor termination terminal fitting through-hole formed in the insulating substrate, and is then folded back on the electrode pattern on the front surface of the insulating substrate;

a second gripping member that is integrally provided with a tip of the rising portion and is folded back along the front surface of the insulating substrate; and a solder layer that electrically connects the first and second gripping members to the electrode patterns.

10. The surface mount variable resistor according to claim 1, wherein a gap is provided between an end surface of the insulating substrate and the front intermediate terminal fitting portion to prevent molten solder from rising.

11. The surface mount variable resistor according to claim 10, wherein a gap is provided between an end surface of the insulating substrate and the rear intermediate terminal fitting portion to prevent molten solder from rising.

* * * * *